US006488129B2

(12) United States Patent
Lamb

(10) Patent No.: US 6,488,129 B2
(45) **Date of Patent: *Dec. 3, 2002**

(54) COOLING DEVICE FOR A DRIVE MEANS OF AN ELEVATOR

(75) Inventor: Miles P. Lamb, Chester, NJ (US)

(73) Assignee: Inteventio AG, Hergiswil (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/428,254

(22) Filed: Oct. 27, 1999

(65) Prior Publication Data

US 2002/0139620 A1 Oct. 3, 2002

(51) Int. Cl.[7] ..... B66B 9/04; B66B 11/02
(52) U.S. Cl. ..... 187/414; 187/272; 60/456
(58) Field of Search ..... 187/414, 272–275, 187/215, 228, 229, 234, 413; 60/456

(56) References Cited

U.S. PATENT DOCUMENTS 4,356,895 A * 11/1982 Kappenhagen et al. ..... 187/272
4,359,143 A * 11/1982 Jackson ..... 187/413 X
4,361,209 A * 11/1982 Kappenhagen et al. ..... 187/272
4,461,341 A * 7/1984 Morrison ..... 60/456 X
4,667,775 A * 5/1987 Stern ..... 187/272

FOREIGN PATENT DOCUMENTS

DE 3001770 A1 * 7/1981 ..... 187/272
JP 551 15 601 5/1980
JP 2-305787 A * 12/1990 ..... 187/272
JP 3-98981 A * 4/1991 ..... 187/272
JP 6-80357 A * 3/1994 ..... 187/414
JP 6-239571 A * 8/1994
JP 7-10426 A * 1/1995
JP 9-89330 A * 4/1997

* cited by examiner

*Primary Examiner*—Eileen D. Lillis
*Assistant Examiner*—Thuy V. Tran
(74) *Attorney, Agent, or Firm*—Cohen, Pontani, Lieberman & Pavane

(57) ABSTRACT

A cooling device for a drive fluid of a lifting device which drives a car of a hydraulic elevator. A fan is present in order to cool the drive fluid. The fan is arranged on the car so that it can ventilate the interior of the car and at least part of the lifting device. The cooling device can be used as a main cooling system and as an auxiliary cooling system. It is suitable in particular for hydraulic elevator systems which do not have a hole in the earth to receive the lifting device.

14 Claims, 2 Drawing Sheets

COOLING DEVICE FOR A DRIVE MEANS OF AN ELEVATOR

BACKGROUND OF THE INVENTION

1. Field of the Invention

The invention relates to a cooling device for the drive of an elevator.

2. Discussion of the Prior Art

Elevator systems which operate a lifting piston using hydraulic fluid generate considerable amounts of heat which are produced by the internal friction of the hydraulic fluid. Cooling devices are necessary to cool the hydraulic fluid.

Japanese reference JP 55115601 discloses a cooling device for the oil of a hydraulic elevator. A fan, which is used when the oil temperature rises, is arranged between the car lifting mechanism and the oil reservoir, on the side of the oil line.

This solution has the disadvantage that, in order to cool the oil, an additional device is used in the machine room, which additional device requires energy and space. In addition, the cooling takes place at a distance from the lifting mechanism. This brings about a situation in which the oil temperature in the lifting mechanism can rise in an uncontrolled way. In addition, the fan is used exclusively for cooling the drive means.

SUMMARY OF THE INVENTION

Accordingly, it is an object of the present invention to provide a cooling device that has the advantage that it is space-saving. At the same time, it is ensured that the drive means is cooled in a simple and low cost manner, directly at the lifting device.

Pursuant to this object, and others which will become apparent hereafter, one aspect of the present invention resides in a cooling device for drive means of a lifting device which drives a car of an elevator, which cooling device comprises a ventilation apparatus for cooling the drive means. The ventilation apparatus is arranged on the car so as to ventilate at least part of the lifting device.

In one embodiment of the invention, the ventilation apparatus is arranged on the car in such a way that it ventilates the interior of the car. This has the advantage that the interior of the car and the lifting device are ventilated simultaneously with a single ventilation apparatus, which gives rise to an energy-saving cooling system.

It is particularly advantageous to have means for conducting the air from the ventilation apparatus to the lifting device to be present inside or outside the car. In this way, the air is conducted to the correct point, without unnecessary losses.

A further advantage is that the means for conducting the air are embodied as a hollow air duct, preferably made of sheet metal, which is connected at one end to an outlet of the ventilation apparatus and at the other end surrounds the lifting device at least partially. These can be manufactured very inexpensively.

It is also advantageous for the lifting device for driving the elevator to be arranged in a depression which extends along one outer side of the car and which also serves as an air duct for the lifting device. Spaces in the elevator system which are already present are therefore used as air ducts. The costs can thus be reduced further.

It is also advantageous for the ventilation apparatus to be a fan, permitting a commercially available device to be used.

In order to reduce costs even further, it is particularly advantageous for the ventilation apparatus to be embodied as a component of a cooling system or to interact with a central cooling system of a building. There is therefore no need for a separate ventilation apparatus.

All the features mentioned can be used not only in the respectively specified combination but also in other combinations or alone, without departing from the scope of the invention.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
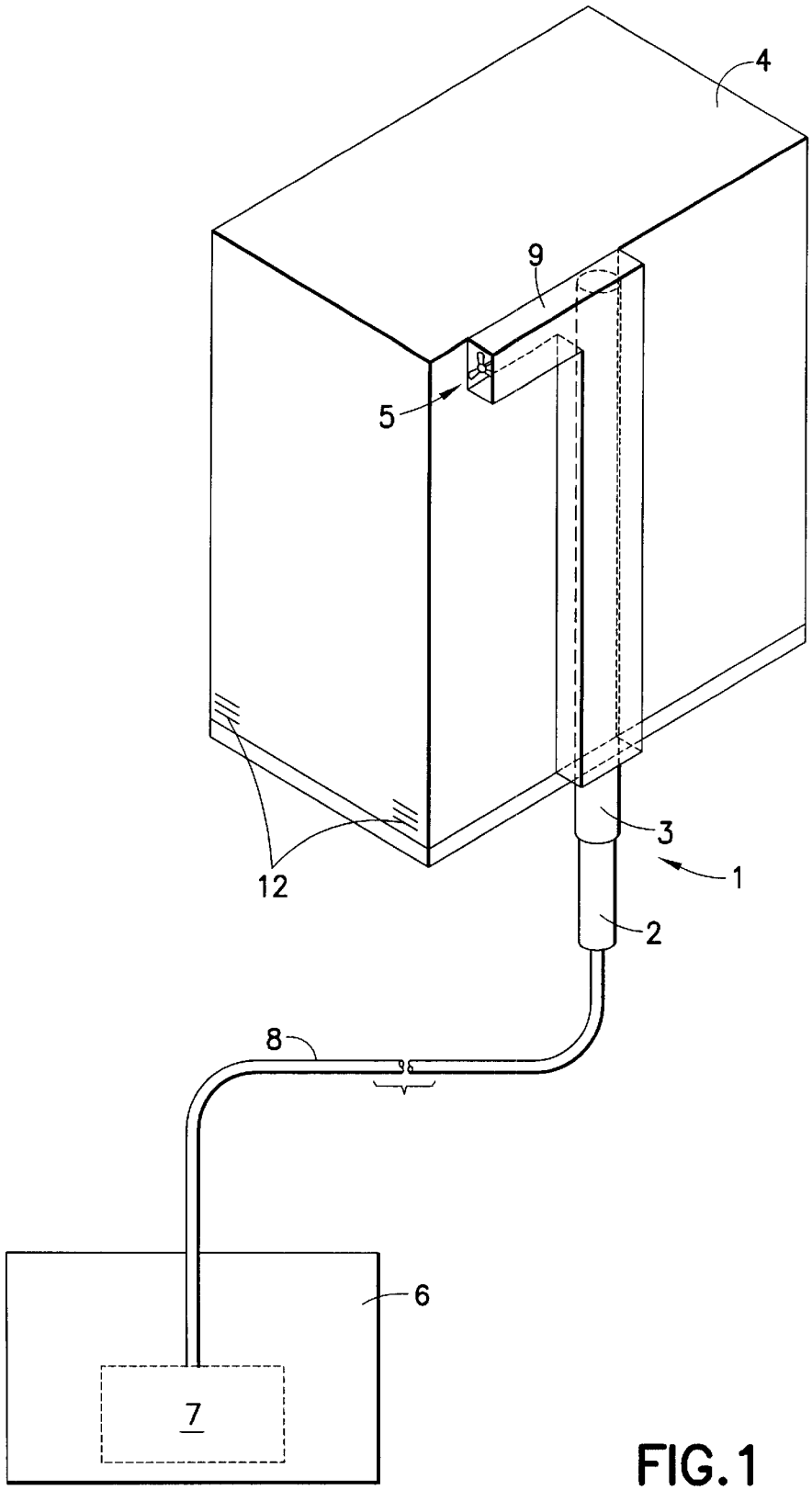
FIG. 1 shows an overall view of a car with a first embodiment of the cooling device pursuant to the present invention.

FIG. 1 illustrates a lifting device 1 which is composed of a piston 2 and a cylinder 3 and which is permanently arranged to the side of the car 4 of an elevator in order to drive the car 4. On the car 4 there is a ventilation apparatus 5, in this embodiment a fan, which is associated, for example, with a cooling system. The lifting device I is driven by a drive means such as a hydraulic fluid, preferably oil. The drive fluid is pumped from a reservoir 6 through the feedline 8 into the piston 2 by means of a pump 7. The cylinder 3 which surrounds the piston 2 is thus pushed upward together with the car 4.

The piston/cylinder unit can also be in a reversed arrangement, i.e. the cylinder 3 can be connected directly to the line 8 and the piston 2 can be pushed upward within the cylinder 3 by the pumped drive fluid.

The heat which is produced mainly by the internal friction of the oil can reach critical temperatures. The fan 5 is used to cool the drive means. It ensures not only that the car 4 is ventilated but also that the oil of the lifting device is cooled using suitable means. For this purpose, there is an air duct 9 present between the fan 5 and the outer casing of the lifting device 1, which air duct 9 opens at one end into the outlet of the fan 5 and at the other end ends at the lifting device. In this way, the cooler air flows around the piston 2 of the lifting device 1. The air duct 9 is preferably fabricated from sheet metal.

Figure 2:
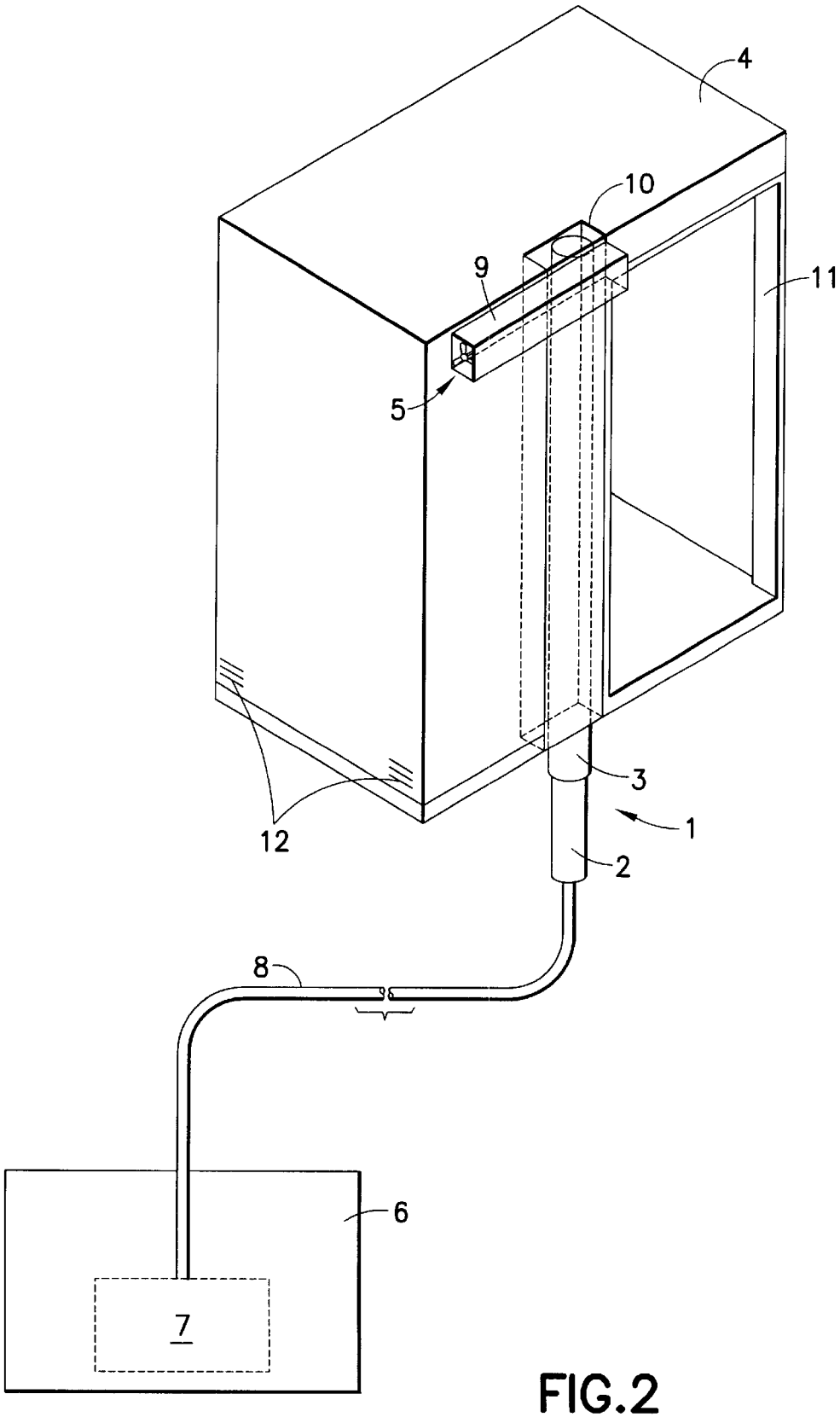
FIG. 2 shows an overall view of a car with a second embodiment of the cooling device.

FIG. 2 shows a lifting device 1 which is arranged in a depression 10 of the car 4 next to the elevator door 11. The movable part of the lifting device 1, in this case the cylinder 3, is permanently connected to the car 4. The depression 10 extends over the entire height of the car 4. The part of the depression 10 which partially surrounds the lifting device 1 can therefore serve as an air duct.

Air is conducted to the lifting device 1 by the discharge air of the ventilation apparatus 5 via the ventilation duct 9. An exchange of heat takes place as a result of the lifting device 1 having a continuous flow around it in its vicinity. This air, because it is at a lower temperature than the temperature of the lifting device, will cool the drive fluid. This is, for example, achieved by means of the car discharge air, i.e. the air of the car 4 is sucked out of the car, for example in order to cool the car or to air-condition it, by means of the ventilation apparatus 5 and is conducted to the lifting device 1 through the air duct 9. The cooling effect occurs because the temperature prevailing in the lifting device is relatively higher than the ambient temperature or the temperature of the car.

In specific application cases, for example in the winter, the direction of flow of the ventilation apparatus can also be reversed so that the car is heated by the heat exchanged at the lifting device.

In a further embodiment, the air in the shaft is cooled/air-conditioned by a cooling system in the shaft wall. In this case it would be advantageous to provide the car with slits so that a better mixture of air between the air in the shaft and the car air can be ensured.

It is easy to understand that various design variants are possible. It would be conceivable, for example, to attach the ventilation apparatus to the car directly at the lifting device in such a way that there is a direct flow around, and cooling of, the lifting device without air ducts.

The ventilation apparatus and the lifting device can also be positioned at locations other than those illustrated.

Two fans positioned one next to the other may also be provided, said fans operating, for example, in opposite directions.

The cooling device can also be used as a main cooling system as well as an auxiliary cooling system.

The cooling device according to the invention is suitable in particular for hydraulic elevator systems which do not have a hole in the earth to receive the lifting device. In elevators whose piston is sunk into the earth, the earth around the hole performs, to a certain extent, the function of an additional cooler for the hydraulic fluid. If this cooling by the earth is absent, this additional cooling is also absent, but this can be performed in the invention by the ventilation apparatus. The means of conducting the air is, as already stated, preferably fabricated from sheet metal. Other materials such as plastic, aluminum, steel, etc. are also expedient and suitable for the function provided in this invention. It is important for the cooling air to be conducted in a way which is favorable in terms of flow dynamics.

The invention is not limited by the embodiments described above which are presented as examples only but can be modified in various ways within the scope of protection defined by the appended patent claims.

I claim:

1. A cooling and ventilation device for cooling a drive fluid of a lifting device which drives a car of an elevator and ventilating the lifting device, the device comprising: a ventilation apparatus for cooling the drive fluid, the ventilation apparatus being mounted on the car so as to ventilate an interior of the car and having an air duct arranged to conduct air from the ventilation apparatus directly to an outer casing of the lifting device, the ventilation apparatus being mounted on the car so as to simultaneously ventilate the interior of the car and cool the drive fluid.

2. A cooling and ventilation device as defined in claim 1, wherein the air duct is arranged outside the car.

3. A cooling and ventilation device as defined in claim 1, wherein the air duct has one end connected to an outlet of the ventilation apparatus and another end that opens at the lifting device.

4. A cooling and ventilation device as defined in claim 3, wherein the air duct is made of sheet metal.

5. A cooling and ventilation device as defined in claim 1, wherein the air duct has one end connected to an outlet of the ventilation apparatus and another end that partially surrounds the lifting device.

6. A cooling and ventilation device as in as defined in claim 1, wherein the lifting device is arranged in a depression which extends along one outer side of the car and which also serves as the air duct for the lifting device.

7. A cooling and ventilation device as defined in claim 1, wherein the ventilation apparatus is a fan.

8. A cooling and ventilation device as defined in claim 1, wherein the ventilation apparatus is embodied as a component of a cooling system.

9. A cooling and ventilation device as defined in claim 1, wherein the lifting device includes a cylinder fixed to the car.

10. A cooling and ventilation device as defined in claim 1, wherein the ventilation apparatus is configured so as to be interactable with a central cooling/air conditioning system of the building.

11. A cooling and ventilation device as defined in claim 1, wherein the ventilation apparatus is configured as a component of a central cooling/air conditioning system of a building.

12. A hydraulic elevator, comprising:

a car having an interior;

a lifting device having an outer casing and a drive fluid for driving the car; and a ventilation apparatus mounted on the car and having an air duct arranged so as to simultaneously ventilate the interior of the car and conduct air directly to the outer casing of the lifting device to cool the drive fluid.

13. A hydraulic elevator as defined in claim 12, wherein the lifting device is arranged in a depression which extends along one outer side of the car and which also serves as an air duct for the lifting device.

14. A hydraulic elevator as defined in claim 12, wherein the lifting device includes a cylinder fixed to the car.

* * * * *